United States Patent [19]

Hagemann

[11] Patent Number: 4,485,955

[45] Date of Patent: Dec. 4, 1984

[54] WIRE LOOP STITCHING MACHINE HEAD WITH CAM-CONTROLLED STAPLE SUPPORTER

[75] Inventor: Casper W. Hagemann, Racine, Wis.

[73] Assignee: Interlake, Inc., Oak Brook, Ill.

[21] Appl. No.: 457,494

[22] Filed: Jan. 12, 1983

[51] Int. Cl.[3] ..... B27F 7/21; B27F 7/23; B27F 7/26

[52] U.S. Cl. ..... 227/89; 227/82; 227/88

[58] Field of Search ..... 227/87, 88, 89, 82, 227/85, 90

[56] References Cited

U.S. PATENT DOCUMENTS

| | | | |
|---|---|---|---|
| 970,461 | 9/1910 | Briggs | 227/88 |
| 1,252,011 | 1/1918 | Maynard | 227/88 |
| 1,637,357 | 8/1927 | Svenson | 227/88 |
| 1,897,625 | 2/1933 | Svenson | 227/88 |
| 2,028,840 | 1/1936 | MacKenzie | 227/88 |
| 2,543,418 | 2/1951 | Morin | 227/88 |

OTHER PUBLICATIONS

Interlake Instruction Manual for Champion Stitchers Form 1132 R5-80, 1980.

*Primary Examiner*—Paul A. Bell
*Attorney, Agent, or Firm*—Emrich & Dithmar

[57] ABSTRACT

A "loop"-type wire stitching machine head includes a reciprocating drive coupled to a staple-forming and driving means and to a wire feed means for feeding a length of staple wire to a holder and severing it. A bender forms the wire over the holder into a generally inverted U-shaped staple. A supporter with a rounded projection is then inserted between the legs of the staple and a drive bar deforms the bight portion of the staple over the projection into a curved loop portion and then drives the formed loop staple into an associated workpiece, retracting the supporter in the process. The supporter is biased to its supporting position and a guide plate guides its movement to that position. A cam positively holds the supporter in its supporting position during forming of the loop portion of the staple and effects positive movement thereof partway to its retracted position after formation of the loop portion to accommodate driving of the staple.

11 Claims, 16 Drawing Figures

WIRE LOOP STITCHING MACHINE HEAD WITH CAM-CONTROLLED STAPLE SUPPORTER

BACKGROUND OF THE INVENTION

The present invention relates to a wire stitching or stapling machine of the type which severs and forms staples from a continuous wire and drives the staples into an associated workpiece. In particular, the invention relates to a stitching head for such a machine.

The present invention is an improvement of the wire loop stitching machine head disclosed in the copending application Ser. No. 420,046 of Alfred J. Gruen, filed Sept. 20, 1982, and assigned to the assignee of the present invention. That stitching machine head is, in turn, an improvement of the wire stitching machine sold by Interlake, Inc. under the trademark "CHAMPION STITCHER". This prior stitching machine includes a stitching head having a wire feed mechanism for feeding a predetermined length of wire from a continuous wire supply to a wire holder, where the length of wire is severed from the supply, and a staple-forming and driving mechanism which forms the severed length of wire into a staple and drives it into an associated workpiece. The mechanism undergoes a cyclical reciprocating movement comprising a drive stroke and a return stroke. During each drive stroke the feed means is feeding a predetermined length of wire to the wire holder, while the staple-forming and driving means is forming and driving the length of wire which had been fed during the preceding drive stroke. Both mechanisms then retract simultaneously, and at the end of each cycle there is left in the wire holder a severed length of wire ready to be formed and driven during the next drive stroke.

A bender in the stitching head operates to form a standard staple which is substantially in the shape of an inverted-U, having a pair of parallel leg portions interconnected by a straight bight portion disposed substantially perpendicular to the leg portions. A supporter then moves, under the urging of bias means and the guidance of a guide plate from a retracted position to a supporting position between the legs of the staple. The supporter has a rounded projection thereon which cooperates with the staple forming and driving means to form the bight portion of the staple or a part thereof into a "loop". Continued movement of the staple forming and driving means then drives the formed staple through an associated workpiece, the legs being folded over by a clincher to complete the stapling or stitching operation. During this driving of the formed staple, the staple forming and driving means cams past the supporter and pushes it back out of the way toward its retracted position. During the return stroke of the staple forming and driving means, the supporter is guided the rest of the way to its retracted position by the guide plate.

It has been found that in practice, during the formation of the loop portion of the staple, the pressure of the staple forming and driving means against the supporter projection has tended to push the supporter back slightly toward its retracted position against the urging of the bias means, thereby resulting in an improper or incompletely formed loop portion, or misalignment of the formed staple. Furthermore, after formation of the loop portion of the staple, the supporter would sometimes hang up and be delayed in movement toward its retracted position by the staple forming and driving means. This would cause undesirable wear on the loop-forming projection of the staple supporter, and might even cause jamming of the machine.

SUMMARY OF THE INVENTION

It is a general object of the present invention to provide an improved wire loop stitching machine head which avoids the disadvantages of prior stitching machine heads while affording additional structural and operating advantages.

An important object of this invention is the provision of a wire loop stitching machine head, which prevents premature withdrawal of the staple supporter during formation of the loop portion of the staple.

In connection with the foregoing object, it is another object of this invention to provide a wire loop stitching machine head of the type set forth, which ensures withdrawal of the staple supporter from its supporting position at the optimum time during each cycle of the machine.

Still another object of this invention is the provision of a wire loop stitching machine head of the type set forth, which minimizes wear on the staple supporter.

It is yet another object of this invention to provide a wire loop stitching machine head of the type set forth which provides a positively controlled movement of the staple supporter.

These and other objects of the invention are attained by providing a wire loop stitching machine head including a staple bending means for bending a length of staple wire into a generally inverted U-shaped staple having a pair of substantially straight parallel legs interconnected by a substantially straight bight portion, staple forging and driving means reciprocating along a drive stroke for driving the staple along a staple path to and through an associated workpiece and a return stroke, a staple supporter carried by the staple forming and driving means and movable with respect thereto between a retracted position out of the staple path and a supporting position disposed in the staple path between the leg portions of the staple and cooperating with the staple forming and driving means for deforming the bight portion of the staple into a curved loop portion and bias means urging the supporter toward its supporting position, the improvement comprising: supporter control means coupled to the staple forming and driving means for movement therewith and coupled to the staple supporter, the control means being responsive to movement of the staple forming and driving means during forming of the loop portion of the staple to prevent movement of the supporter from its supporting position, the control means being responsive to movement of the staple forming and driving means along its drive stroke after formation of the loop portion of the staple to positively move the supporter toward the retracted position thereof and out of the staple path.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
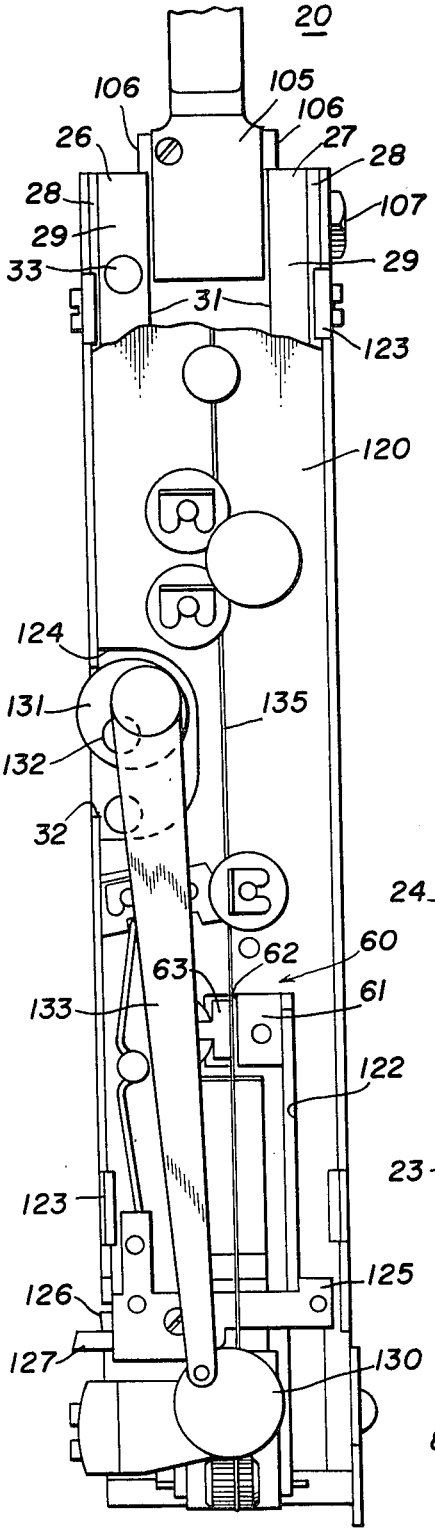
FIG. 1 is a fragmentary, front elevational view of a stitching machine head constructed in accordance with and embodying the features of the present invention, with a portion of the face plate broken away.
Figure 2:
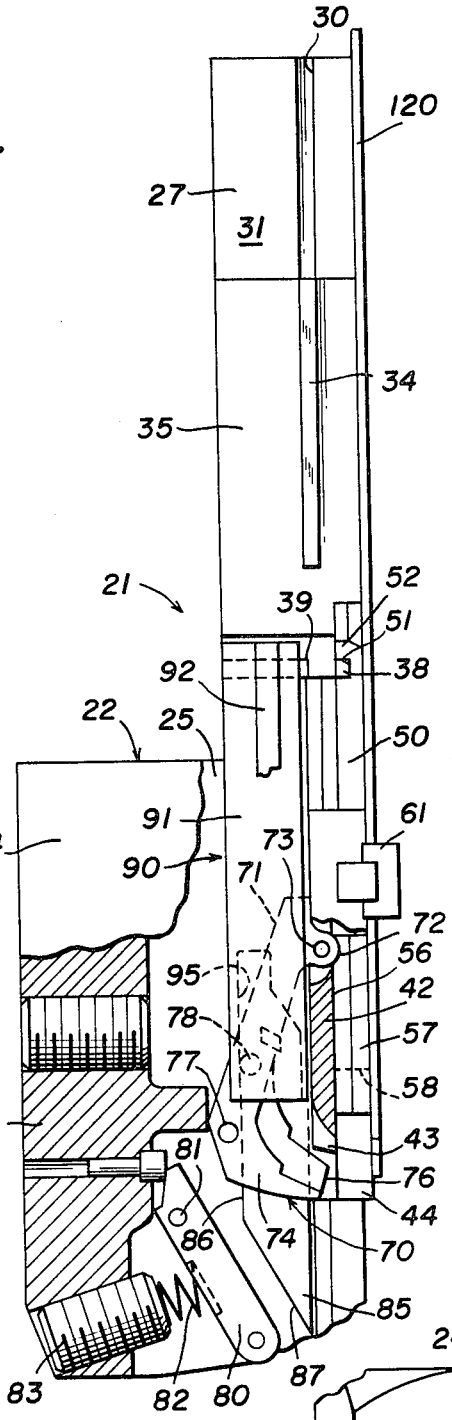
FIG. 2 is a fragmentary, side elevational view of the stitching machine head of FIG. 1, as viewed from the left-hand side thereof, in partial vertical section and with portions thereof broken away, and with the parts illustrated in their fully retracted position.

Referring to FIGS. 1 through 4 of the drawings, there is illustrated a stitching head, generally designated by the numeral 20, constructed in accordance with and embodying the features of the present invention, which is adapted for use in a "loop"-type wire stitching machine of the type described in the aforementioned U.S. application Ser. No. 420,046. The stitching head 20 is, in many respects, identical to that disclosed in the aforementioned application and, therefore, only so much of the stitching head 20 as is necessary for an understanding of the present invention will be described herein, and the aforementioned prior application may be referred to for an explanation of the remaining portions of the stitching head 20 and the manner in which it coacts with the associated wire stitching machine.

The stitching head 20 includes a metal frame, generally designated by the numeral 21, which is preferably in the form of a single-piece casting. The frame 21 includes a channel-shaped base portion 22 having a rear wall 23 and two forwardly-extending side walls 24 and 25, respectively provided with elongated upstanding extension portions 26 and 27 which are disposed forwardly of the rear wall 23 and cooperate to define a slot therebetween. The forward edges of the side walls 24 and 25 are recessed along substantially the entire length thereof to define first relatively shallow shoulders 28 and second deeper shoulders 29. Extending the length of the side walls 24 and 25 a slight distance rearwardly of the level of the second shoulders 29 are elongated rectangular grooves 30 formed in inner side surfaces 31 of the side walls 24 and 25. The front edges of the side walls 24 and 25 are cut away at the lower ends thereof to the levels of the second shoulders 29. The side wall 24 is also cut away, as at 32, intermediate the ends thereof to the level of the second shoulders 29. Integral with the shoulder 29 of the side wall 24 adjacent to the upper end thereof and projecting forwardly therefrom is a cylindrical locating pin 33.

Disposed between the extension portions 26 and 27 of the side walls 24 and 25 is a drive slide 35 in the form of a rectangular block having guide rails 34 (see FIG. 3) respectively projecting laterally from the opposite sides thereof and slidably received in the grooves 30. The front surface of the drive slide 35 is recessed as at 36, the recessed portion being provided with a pin 37 projecting forwardly therefrom. The lower end of the front surface of the drive slide 35 is recessed and has projecting forwardly therefrom a laterally extending rectangular lug 38. Similarly, a rectangular lug 39 projects from one side of the drive slide 35 at the recessed lower end thereof.

Disposed between the side walls 24 and 25 immediately below the drive side 35 is a staple forming and driving assembly, generally designated by the numeral 40, which includes a channel-shaped bender bar 41 having a rectangular rear wall 42 provided with an arcuate cutout 43 at the lower end thereof and integral along the opposite side edges thereof with two forwardly projecting side walls 44. Each of the side walls 44 is provided with a laterally projecting guide rail 44*a* extending the length thereof and respectively disposed for sliding engagement in the grooves 30. Extending laterally across the side walls 44 at the front edges thereof is a latch channel 45 receiving therein a latch bar 46 in the form of a rectangular member provided respectively at the opposite ends thereof with forwardly projecting cam lugs 47 and 48. The cam lug 47 is provided with a notch in the outer edge thereof in which is received a bias spring leaf 49, which resiliently urges the latch bar 46 to the right, as viewed in FIG. 3.

Figure 3:
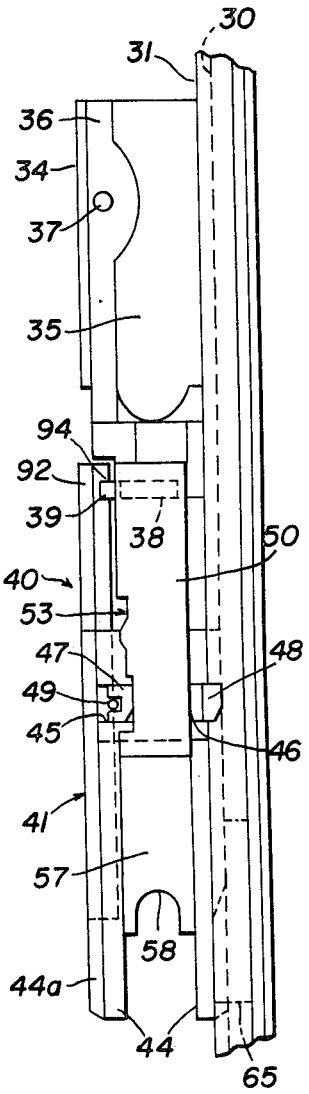
FIG. 3 is a fragmentary, front elevational view of the staple forming and driving means of the head of FIG. 2, with the face plate and the left-hand portion of the head broken away.

The staple forming and driving assembly 40 also includes a rectangular drive bar 50 disposed between the side walls 44 of the bender bar 41 for sliding movement with respect thereto. The upper end of the drive bar 50 has a laterally extending groove 51 in the rear surface thereof for receiving the lug 38 of the drive slide 35 so that the drive bar 50 moves with the drive slide 35. Formed along the left-hand side of the drive bar 50, as viewed in FIG. 3, is a latch recess 53 provided intermediate the ends thereof with a laterally extending cam projection 54 (see FIG. 6). The lower end of the latch recess 53 communicates with a deeper latch notch 55. The lower end of the drive bar 50 is recessed along the front surface thereof, as at 56 (see FIG. 2), for receiving therein a rectangular drive member 57 provided with an arcuate notch 58 at the lower end thereof.

The stitching head 20 also includes a wire feed assembly, generally designated by the numeral 60, for feeding a stitching wire 135 from a continuous supply (not shown) thereof. The wire 135 extends longitudinally of the stitching head 10 through associated straightening and tensioning means to the wire feed assembly 60. The wire feed assembly 60 includes a wire gripping block 61 which spans the side walls 44 of the bender bar 41 and is fixedly secured thereto. The block 61 has a channel 62 formed in the front surface thereof which is generally cruciform in shape and receives therein a gripping member 63 which is disposed in engagement with the bias spring leaf 49 for urging the gripping member 63 to the right, as viewed in FIG. 1, for cooperation with the block 61 to grip the wire 135 therebetween.

The wire feed assembly 60 also includes a cam member 65 (see FIG. 6) which is a flat, elongated, generally rectangular member having a relatively wide body portion with a narrow stem projecting from the upper end thereof. One side edge of the cam member 65 defines a cam surface 66 which includes an inclined portion 67. The cam member 65 is fixedly secured to the inner surface of a rectangular face plate 120, to be described more fully below.

Disposed behind the bender bar 41 and pivotally coupled thereto is a staple supporter 70, which has a rectangular body 71 provided at the upper end thereof with a forwardly extending attachment lug 72 (see FIG. 2) which is received in a complementary recess in the rear wall 42 of the bender bar 41 and is pivotally coupled thereto by a pivot pin 73. The lower end of the body 71 has a forwardly extending foot 74 having an elongated curved projection 75 (see FIG. 5) thereon extending along the length thereof centrally thereof and upwardly a slight distance along the body 71, the projection 75 being substantially part-circular in transverse cross section. The distal end of the foot 74 terminates in a flat end wall 76. Respectively projecting laterally from the opposite sides of the body 71 are a guide pin 77 and cam follower pin 78. The portions of the side walls 44 of the bender bar 41 which extend downwardly below the lower end of the rear wall 42 accommodate therebetween the foot 74 of the supporter 70.

A lever 80 (see FIG. 2) is mounted between the side walls 24 and 25 of the frame 21 for pivotal movement about the axis of a pivot pin 81. Seated in a recess in the rear surface of the lever 80 is one end of a compression spring 82, the other end of which is received in a bushing plug 83 threadedly engaged in a complementary bore in the rear wall 23 of the frame 21, whereby the lever 80 is resiliently urged forwardly (to the right, as viewed in FIG. 2). Fixedly secured to the inner surface of the side wall 25 of the frame 21 adjacent to the lower end thereof is a flat guide plate 85 having a vertical guide surface 86 and a forwardly and downwardly inclined guide surface 87, both disposed for guiding engagement with the guide pin 77 of the supporter 70.

Figure 4:
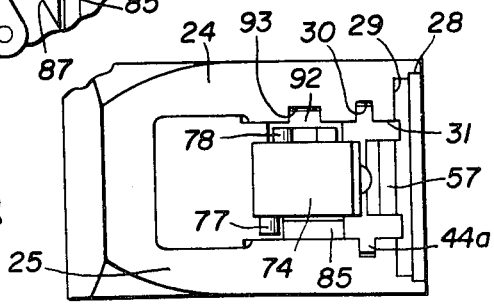
FIG. 4 is a fragmentary, bottom plan view of the stitching machine head of FIG. 2.
Figure 15:
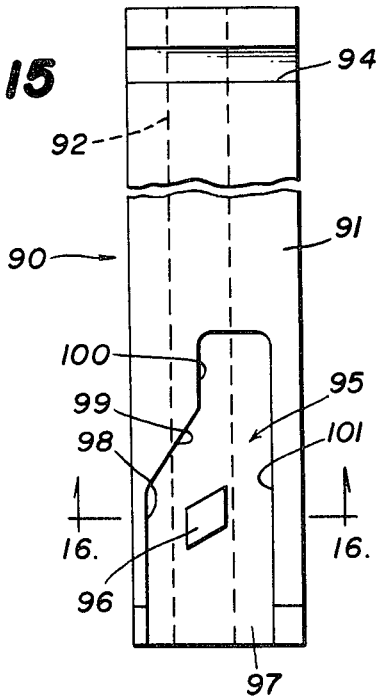
FIG. 15 is an enlarged, side elevational view of the supporter control cam constructed in accordance with and embodying the features of the present invention, with a portion of the structure broken away.
Figure 16:
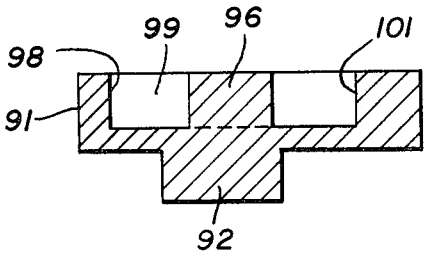
FIG. 16 is a further enlarged view in horizontal section taken along the line 16—16 in FIG. 15.

Referring now also to FIGS. 15 and 16 of the drawings, it is a significant aspect of the present invention that there is also provided a cam member, generally designated by the numeral 90, which includes an elongated rectangular body 91 provided along one side thereof with a laterally projecting guide rib 92 adapted to be received for sliding engagement in a complementary groove 93 in the side wall 24 of the frame 21 (see FIG. 4). The other side of the body 91 is provided at the upper end thereof with a laterally extending groove 94 for receiving therein the lug 39 of the drive slide 35, thereby to couple the cam member 90 to the drive slide 35 for movement therewith. The same side surface of the body 91 is provided at the lower end thereof with an irregular cam recess 95 which extends all the way to the lower end of the body 91. A land 96, generally in the form of a parallelogram, is positioned centrally of the cam recess 95 and cooperates with the peripheral walls thereof to form a generally loop-shaped cam track having a lower neutral portion 97 beneath the land 96, a retaining portion 98, an inclined cam portion 99, a vertically extending clinch portion 100 and a vertically extending retract portion 101. The cam follower pin 78 is disposed in the cam recess 95 for camming engagement with the cam surfaces thereof.

Disposed between the frame side wall extension portions 26 and 27 at the upper ends thereof is a wire guide bracket 105 (see FIG. 1) which is provided with laterally outwardly extending guide ribs 106 keyed into the grooves 30 in the frame side wall extensions 26 and 27. The bracket 105 is fixedly secured to the frame 21 by a mounting screw 107 and carries thereon a wire guide (not shown) for guiding the wire 135 from the associated supply to the stitching head 20. The face plate 120 is dimensioned to rest upon the shoulders 28 of the frame 21. Formed in the face plate 120 adjacent to the upper end thereof is a circular aperture (not shown) for receiving therethrough the locating pin 33 of the frame 21. Thus, the portions of the side walls 24 and 25 projecting forwardly of the shoulders 28 cooperate laterally to retain the face plate 120, while the locating pin 33 operates to prevent longitudinal movement of the face plate 120, whereby the face plate 120 is fixedly positioned with respect to the frame 21, being held in place by suitable clamps 123.

The face plate 120 is provided adjacent to the lower end thereof with a rectangular window or cutout 122 through which the wire gripping block 61 projects forwardly. The left side edge of the face plate 120, as viewed in FIG. 1, has an arcuate cutout or recess 124 formed therein. Fixedly secured to the face plate 120 at the lower end thereof is a cutter housing 125 having a channel (not shown) formed in the rear surface thereof for accommodating therein a fixed cutter 126 and a movable cutter 127, the latter being operated by a cutter operating slide (not shown) for cooperation with the fixed cutter 126 to sever the predetermined length of the wire 135 after it has been fed by the wire feed assembly 60, in a well known manner.

Also mounted on the frame 21 immediately below the cutter housing 125 is a cylindrical wire holder 130 which receives the length of the fed wire and holds it after it has been severed from the wire supply. The wire holder 130 is mounted for rotation to move the cut length of wire from a vertical orientation illustrated in the drawings to a horizontal orientation for formation into a staple. Rotation of the wire holder 130 is effected by a cylindrical operating cam 131 which has an eccentric bore therethrough for receiving therein a mounting pin 132 which is fixedly secured to the shoulder 29 of the frame side wall 24 centrally of the recess 124. In operation, as the drive slide 35 moves upwardly and downwardly, the pin 37 (see FIG. 3) thereof moves into a slot (not shown) on the operating cam 131 for rotating it, the operating cam 131 being coupled by a spring arm 133 to the wire holder 130 for effecting a corresponding rotation thereof, all in a well known manner.

Referring now also to FIGS. 5 through 14 of the drawings, the operation of the stitching head 20 will be described in detail. Initially the parts are in the position illustrated in FIGS. 1 through 4, with the staple forming and driving assembly 40 in its upper or neutral position, and the supporter 70 in its fully retracted position. The leading end of the wire 135 has been fed from the supply downwardly across the front of the face plate 120 and through the channel 62 in the wire gripping block 61, and thence through a complementary bore in the cutter housing 125. Essentially, the drive slide 35 undergoes a reciprocating up-and-down motion including a downward drive stroke and an upward retraction stroke during each cycle of operation of the stitching head 20. When the stitching head 20 is in its return or neutral condition, illustrated in FIGS. 1–4, the gripping member 63 and the latch bar 46 are held in their gripping condition by the bias spring leaf 49 for securely gripping the wire 135. The cam lug 47 of the latch bar 46 is held in the latch notch 55 of the drive bar 50. The guide pin 77 is disposed in engagement with the vertical guide surface 86 of the guide plate 85 for holding the supporter 70 in its fully retracted position. The cam follower pin 78 is disposed in the neutral portion 97 of the cam recess 95. In this position, the cam member 90 has no control over the movement of the supporter 70. It will be appreciated that a severed length of wire 135 is held horizontally in the wire holder 130, having been fed and severed in the preceding cycle of the stitching head 20.

Figure 5:
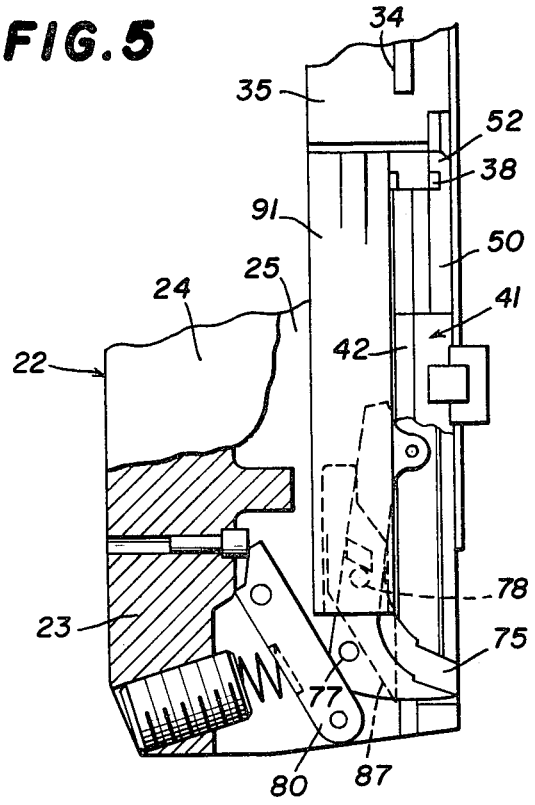
FIG. 5 is a view similar to FIG. 2, and illustrating the parts in an intermediate position with the staple forming and driving means part way down along the drive stroke thereof.
Figure 6:
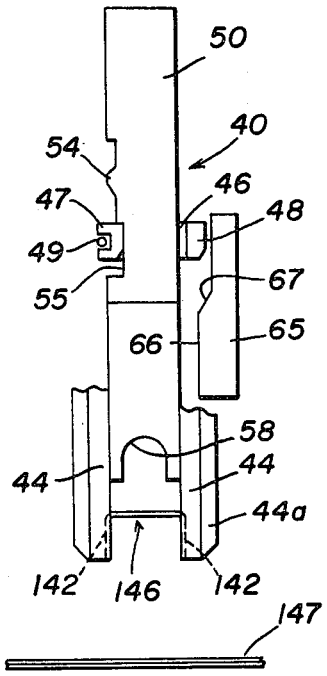
FIG. 6 is a fragmentary, front elevational, partially diagrammatic view of the staple forming and driving means in the position of FIG. 5.

Referring to FIGS. 5 and 6 of the drawings, as the cycle is started, the drive slide 35 moves downwardly, carrying with it the drive bar 50 and the cam member 90. The drive bar 50 drives the latch bar 46 and the bender bar 41 downwardly with it, the lower end of the bender bar 41 picking up the opposite ends of the severed length of stitching wire 135 and bending them downwardly to form a generally inverted U-shaped staple 140 (see FIG. 6) having a straight bight portion 141 integral at the opposite ends thereof with a pair of depending leg portions 142. The downward movement of the bender bar 41 carries with it the supporter 70. The foot 74 of the supporter 70 is pushed forwardly between the legs 142 of the staple 140 by the lever 80, this movement being guided by the engagement of the guide pin 77 on the inclined guide surface 87 of the guide plate 85. The cam follower pin 78 remains in the neutral portion 97 of the cam recess 95, to accommodate this forward movement of the supporter 70 from its retracted position.

Figure 7:
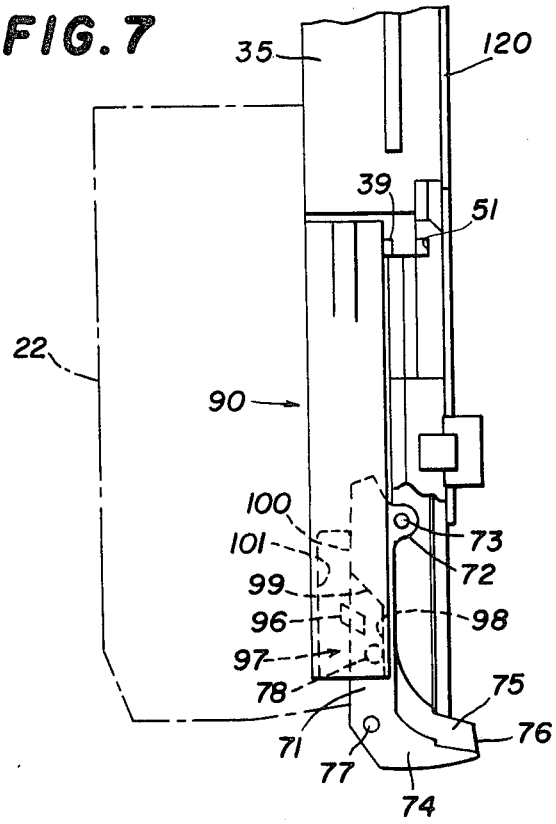
FIG. 7 is a partially diagrammatic view similar to FIG. 5, illustrating the parts in their position after the staple has been bent into its inverted U-shaped configuration and just before formation of the loop portion of the staple.
Figure 8:
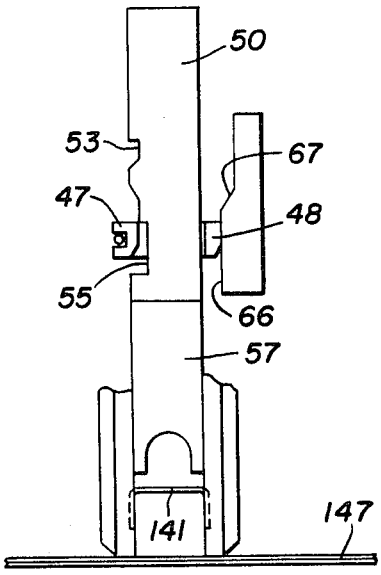
FIG. 8 is a view similar to FIG. 6, illustrating the parts in the position of FIG. 7.
Figure 9:
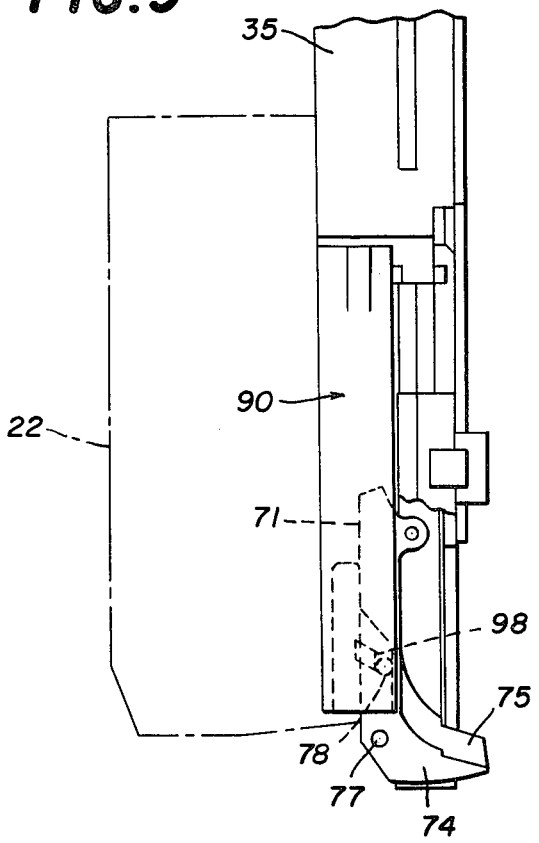
FIG. 9 is a view similar to FIG. 7, illustrating the parts during formation of the loop portion of the staple.
Figure 10:
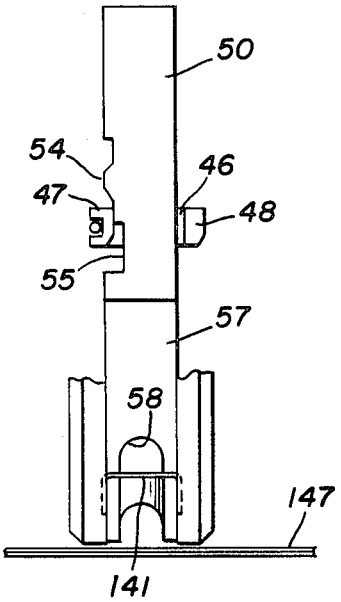
FIG. 10 is a view similar to FIG. 8, illustrating the parts in the position of FIG. 9.
Figure 11:
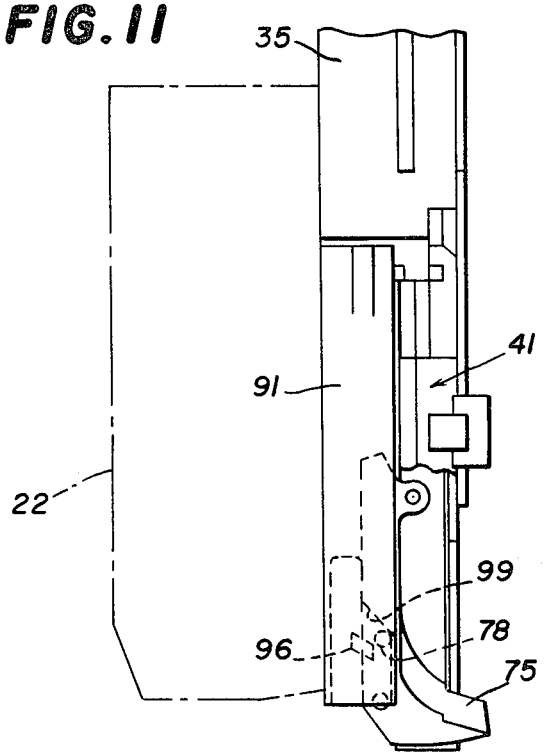
FIG. 11 is a view similar to FIG. 9, illustrating the parts after formation of the loop portion of the staple.

Referring to FIGS. 7 and 8, the continued downward movement of the drive slide 35 allows the supporter 70 to be moved completely to its supporting position, illustrated in FIG. 7, as the guide pin 77 passes beneath the lower end of the guide plate 85. At about the same time, the cam lug 48 of the cam bar 46 engages the inclined portion 67 of the cam surface 66 on the cam member 65 and is pushed to the left, as viewed in FIG. 8, against the urging of the bias spring leaf 49. This moves the gripping member 63 to the left until, when the cam lug 48 reaches the lower vertical portion of the cam surface 66, the movement of the latch bar 46 serves to release the wire 135 and terminate the feeding thereof, and also moves the cam lug 47 out of the latch notch 55 as the lower end of the bender bar 41 bottoms out on the workpiece 147. Thus, continued downward movement of the drive slide 35 will move the drive bar 50 with respect to the bender bar 41, the latter remaining stationary.

Figure 12:
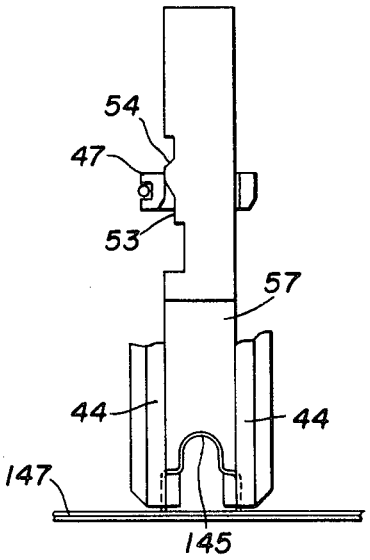
FIG. 12 is a view similar to FIG. 10, illustrating the parts in the position of FIG. 11.

Referring to FIGS. 9 to 12, as the lower end of the drive bar 50 reaches the staple 140 it engages the bight portion 141 and pushes it downwardly over the projection 75 of the supporter 70, the end notch 58 in the drive bar 50 accommodating the projection 75 therein and cooperating therewith to form the loop portion 145 of the staple 140 (see FIG. 12). As the loop portion 145 is being formed, the cam 90 moves down so that the cam follower pin 78 rides up into the retaining portion 98 of the cam recess 95, the land 96 serving to prevent rearward movement of the supporter 70 from its supporting position (see FIG. 9). Thus, despite the tendency of the drive bar 50 to push the supporter 70 rearwardly during formation of the loop portion 145 of the staple 140, the cam 90 serves fixedly to hold the supporter 70 in its supporting position. During this forming operation, the cam projection 54 of the drive bar 50 cams past the cam lug 48 of the latch bar 46 (see FIG. 12).

Figure 13:
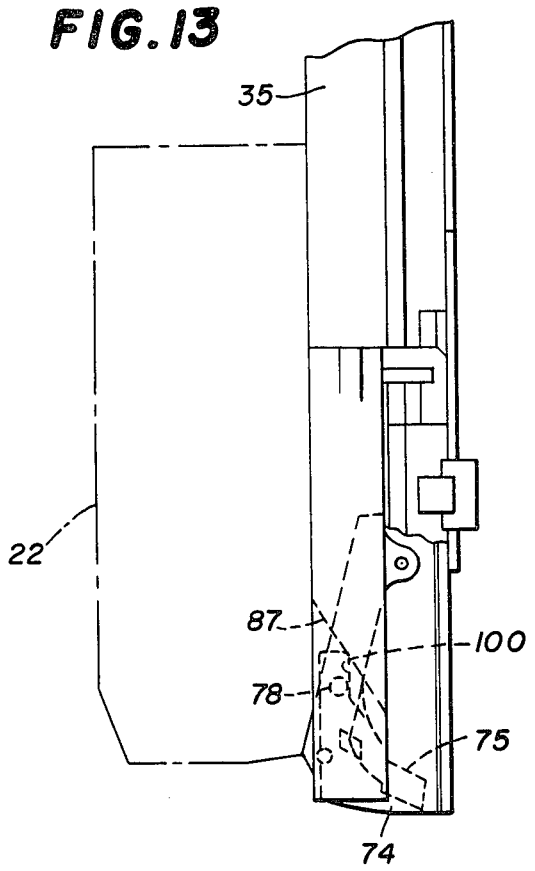
FIG. 13 is a view similar to FIG. 11, illustrating the parts in their position after driving of the staple through the associated workpiece.
Figure 14:
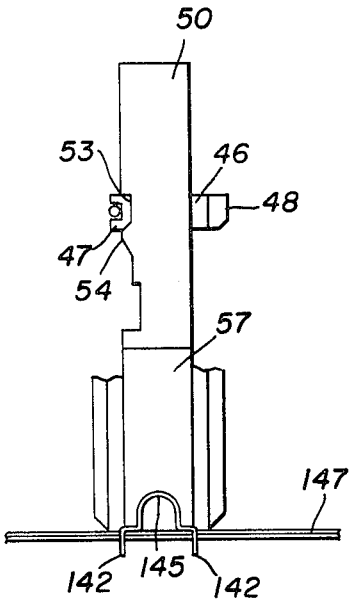
FIG. 14 is a view similar to FIG. 12, illustrating the parts in the position of FIG. 13.

Referring to FIGS. 13 and 14 the continued downward movement of the drive bar 50 drives the staple 140 into and through the workpiece 147. During this driving operation, the downward movement of the cam member 90 causes the cam follower pin 78 to ride up into the cam portion 99 of the cam recess 95 (see FIGS. 11 and 13) for driving the supporter 70 back part way toward its retracted position, and out of the path of the drive bar 50, the cam member 90 serving to effect this retracting movement at precisely the right time. As the staple 140 is driven through the workpiece 147, the cam lug 48 drops into the latch recess 53 above the cam projection 54 on the drive bar 50 (see FIG. 14). The cam follower pin 78 then moves into the clinch portion 100 of the cam recess 95, which holds the supporter 70 back out of the path of the drive bar 50 during clinching of the formed staple 140. This clinch portion 100 of the cam recess 95 has a length sufficient to allow for different work thicknesses up to $\frac{1}{8}$ inch, and allows the cam member 90 to continue moving downward without interference from the cam follower pin 78.

As the staple 140 is clinched, the drive slide 35 bottoms out and reverses direction and begins moving upwardly along its return stroke, carrying with it the drive bar 50 and the cam member 90. Because the cam projection 54 on the drive bar 50 engages the cam lug 48 of the latch bar 46 (see FIG. 14), the bender bar 41 is also carried upwardly with the drive slide 35, so that the supporter 70 moves upwardly along with the cam member 90 and remains stationary with respect thereto. This configuration is maintained until the guide pin 77 engages the inclined guide surface 87 of the guide plate 85, for pulling the supporter 70 rearwardly all the way to its fully retracted position, this movement being accommodated by the width of the clinch portion 100 of the cam recess 95. The supporter 70 is held in its retracted position by the vertical guide surface 86 of the guide plate 85.

The upward movement of the bender bar 41 continues until the wire gripping block 61 engages the upper edge of the rectangular window 122 in the face plate 120. This stops the upward movement of the bender bar 41, but the upward movement of the drive bar 50 continues, the cam projection 54 being cammed past the cam lug 48, pushing the latch bar 46 to the left, as viewed in FIG. 14. When the drive slide 35 and the drive bar 50 have returned to their original return position, the cam lug 48 snaps back into the latch notch 55 of the drive bar 50, the gripping member 63 moving with it to again grip the supply portion of the wire 135 in preparation for feeding during the next cycle of operation of the stitching head 20. It will be appreciated that after the bender bar 41 is stopped, the continued upward movement of the drive bar 50 is accommodated by the retract portion 101 of the cam recess 95, the cam follower pin 78 moving down along this retract portion 101 and arriving back at the neutral portion 97 when the parts have returned to their original neutral position, illustrated in FIG. 2.

The operation of the other parts of the stitching head 20 are substantially as disclosed in the aforementioned copending application Ser. No. 420,046. Thus, it will be understood that, when the supply portion of the wire 135 is released by the wire feed assembly 60 by the action of the cam member 65, the movable cutter 127 is operated to sever the just-fed length of wire from the supply thereof, the severed length of wire being held by the wire holder 130. The length of the feed stroke is such that the severed length of stitching wire 135 extends substantially equidistantly above and below the wire holder 130. Because the position of the cam member 65 is fixed with respect to the face plate 120, which is in turn fixedly positioned on the frame 21, the position of release of the wire 135 by the wire gripping assembly 60 is fixed, resulting in a fixed, predetermined-length wire draw during each cycle of operation of the stitching head 20.

Thus, as can be seen in FIG. 1, the slot between the extension portions 26 and 27 of the frame side walls 23 and 25 is vacant beneath the wire guide bracket 105, the face plate clamping block normally disposed in that position in prior stitching heads, such as the Interlake "CHAMPION STITCHER", no longer being necessary. Similarly, it can be seen that there is no longer necessary the pivoting lever which is mounted on the wire guide bracket 105 in the CHAMPION STITCHER head and the elongated grip release slide bar which is normally connected to that lever. The slide bar is replaced by the very short cam member 65, which has an overall length substantially less than the length of the travel of the wire gripping assembly 60.

When the drive slide 35 begins to move back toward its return position, this upward movement causes a counterclockwise rotation of the operating cam 131, as viewed in FIG. 1, resulting in a clockwise rotation of the wire holder 130 for reorienting the severed length of wire horizontally so that it will be in position for forming during the next cycle of operation of the stitching head 20, all in a well known manner.

While the present invention has been disclosed in connection with a stitching head 20 of the type used for forming "loop"-type staples, of the kind illustrated in the aforementioned copending application Ser. No. 420,046, it will be appreciated that the principles of this invention could also be applied to other types of stitching heads.

From the foregoing, it can be seen that there has been provided an improved stitching head for a wire loop stitching machine which provides a positively controlled movement of the staple supporter to ensure that it remains in supporting position during formation of the loop portion of the staple and to ensure that its movement toward its retracted position is initiated at precisely the proper time in each cycle of operation.

I claim:

1. In a wire loop stitching machine head including a staple bending means for bending a length of staple wire into a generally inverted U-shaped staple having a pair of substantially straight parallel legs interconnected by a substantially straight bight portion, staple driving means reciprocating along a drive stroke and a return stroke, the staple driving means being coupled to the bending means for movement thereof during an initial portion of the driving stroke for bending the staple wire, the staple driving means being decoupled from the bending means during a later portion of the driving stroke for driving the staple along a staple path to and through an associated workpiece, a staple supporter carried by the bending means and movable with respect thereto between a retracted position out of the staple path and a supporting position disposed in the staple path between the leg portions of the staple and cooperating with the staple driving means for deforming the bight portion of the staple into a curved loop portion and bias means urging the supporter toward its supporting position, the improvement comprising: supporter control means coupled to the staple driving means for movement therewith and coupled to the staple supporter, said control means being responsive to movement of the staple driving means with respect to the bending means during forming of the loop portion of the staple to prevent movement of the supporter from its supporting position, said control means being responsive to movement of the staple driving means along its drive stroke after formation of the loop portion of the staple to positively move the supporter toward the retracted position thereof and out of the staple path.

2. The stitching machine head of claim 1, wherein said supporter control means comprises a cam.

3. The stitching machine head of claim 2, and further including a cam follower carried by said supporter and disposed in camming engagement with said cam.

4. The stitching machine head of claim 1, wherein said supporter control means includes means responsive to movement of the staple driving means during driving of the staple through the associated workpiece for holding the supporter out of the staple path.

5. The stitching machine head of claim 1, wherein said control means comprises a cam member having a cam recess therein, and further including a follower pin carried by the supporter and disposed in said cam recess for cammed movement therealong.

6. The stitching machine head of claim 1, and further including fixed guide means engageable with the supporter for guiding movement thereof to and from its retracted position.

7. In a wire loop stitching machine head including a staple bending means for bending a length of staple wire into a generally inverted U-shaped staple having a pair of substantially straight parallel legs interconnected by a substantially straight bight portion, staple driving means reciprocating along a drive stroke and a return stroke, the staple driving means being coupled to the bending means for movement thereof during an initial portion of the driving stroke for bending the staple wire, the staple driving means being decoupled from the bending means during a later portion of the driving stroke for driving the staple along a staple path to and through an associated workpiece, a staple supporter carried by the bending means and movable with respect thereto between a retracted position out of the staple path and a supporting position disposed in the staple path between the leg portions of the staple and cooperating with the staple driving means for deforming the bight portion of the staple into a curved loop portion, bias means urging the supporter toward its supporting position, and guide means engageable with the supporter for guiding it to and from its retracted position in response to movement of the bending means, the improvement comprising: a cam follower carried by the supporter, and cam means carried by the driving means for movement therewith and having a cam surface disposed for engagement with said cam follower, the guide means guiding movement of the supporter from its retraction position to its supporting position in response to movement of the bending means during the initial portion of the drive stroke of the staple driving means, said cam means being responsive to movement of the staple driving means during forming of the loop portion of the staple to prevent movement of the supporter from its supporting position, said cam means being responsive to movement of the staple driving means along its drive stroke after formation of the loop portion of the staple to positively move the supporter part-way toward the retracted position thereof and out of the staple path, the guide means guiding movement of the supporter the rest of the way to its retracted position in response to movement of the bending means during movement of the staple driving means along its return stroke.

8. The stitching machine head of claim 7, wherein said cam means defines a generally loop-shaped path for said cam follower.

9. The stitching machine head of claim 7, wherein said cam means comprises a cam member having a cam recess formed therein and a land disposed generally centrally of said recess so that said recess defines a generally loop-shaped path around said land.

10. The stitching machine head of claim 7, wherein said cam means includes a cam recess, said cam follower comprising a pin disposed in said cam recess, said cam recess defining a generally loop-shaped path for said pin, said cam recess having a stem portion for accommodating said pin during driving of the associated staple through a workpiece.

11. The stitching machine head of claim 10, wherein said stem portion of said cam recess has a length sufficient to accommodate driving of the staple through workpieces of different thickness.

* * * * *